United States Patent [19]

Gregg

[11] Patent Number: 4,845,782

[45] Date of Patent: Jul. 11, 1989

[54] CAP

[76] Inventor: Ron Gregg, 2716 NE. 106th Pl., Seattle, Wash. 98125

[21] Appl. No.: 114,339

[22] Filed: Oct. 28, 1987

[51] Int. Cl.[4] ..... A42B 1/06; A42B 1/04; A42B 1/22

[52] U.S. Cl. ..... 2/172; 2/6; 2/183; 2/197

[58] Field of Search ..... 2/172, 183, 195, 197, 2/6

[56] References Cited

U.S. PATENT DOCUMENTS

| | | | |
|---|---|---|---|
| 1,486,776 | 3/1924 | McKnight | 2/183 |
| 1,505,978 | 8/1924 | Stetson | 2/6 |
| 1,557,280 | 10/1925 | Watson | 2/183 |
| 1,831,767 | 11/1931 | Klein | 2/197 |
| 1,992,285 | 2/1935 | Blum | 2/183 |
| 2,040,355 | 5/1936 | Witcoff | 2/183 |
| 2,417,986 | 3/1947 | Marder et al. | 2/172 |
| 3,396,408 | 8/1968 | Enger | 2/183 |
| 4,011,600 | 3/1977 | Malk | 2/197 |

OTHER PUBLICATIONS

The Journal of the American Medical Association, vol. 168, No. 7, p. 930-dated Oct. 19, 1958.

*Primary Examiner*—Werner H. Schroeder
*Assistant Examiner*—Jeanette E. Chapman
*Attorney, Agent, or Firm*—Robert W. Beach; Ward Brown

[57] ABSTRACT

A cap has a sizing band adjustable in effective length by the use of hook and pile fasteners which sizing band can also retain a liner in the cap. A hook and pile fastener can be used alternatively to hold earflaps in upward-folded position or, when the earflaps are extending downward, the fastener can be used to attach the ends of a chin strap to the earflaps. A drawstring can be drawn to gather a neck flap and earflaps into snug engagement with the wearer's neck.

4 Claims, 4 Drawing Sheets

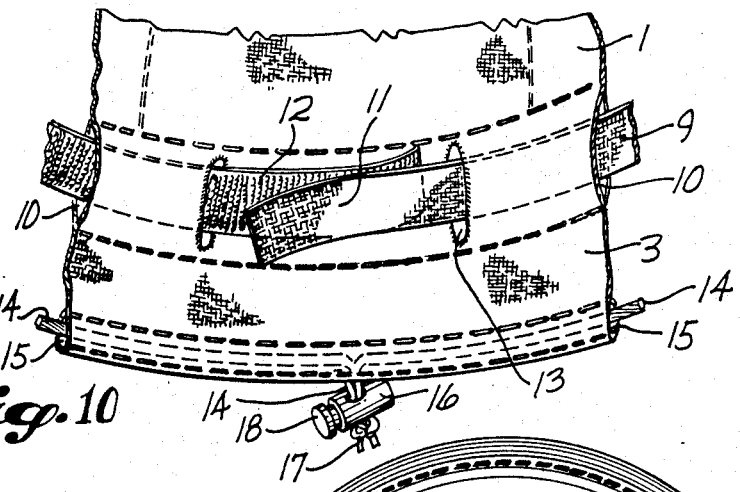
Fig. 10
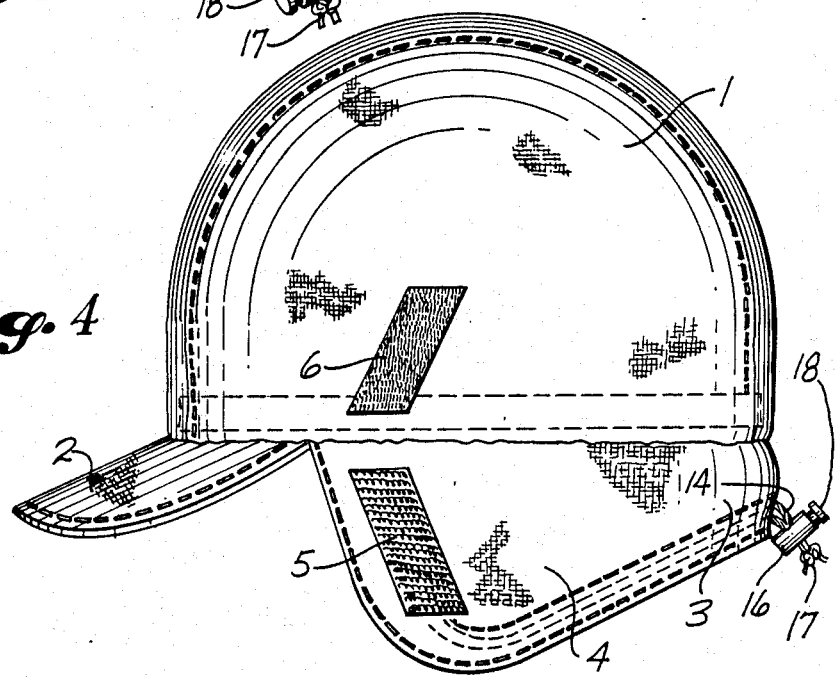
Fig. 4
Fig. 5
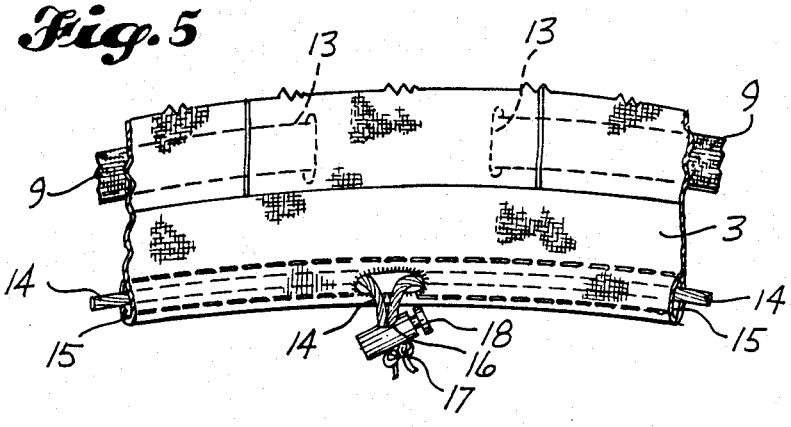

CAP

BACKGROUND OF THE INVENTION

1. Field of the Invention

The present invention relates to caps especially of the type worn by sportsmen and more particularly to a neck flap, earflaps, a chin strap, a liner and structure for sizing the cap or other headgear.

2. Prior Art

Sportsmen's caps generally have been known, which have neck flaps and earflaps and may have chin straps.

Also, sizing devices for caps have been known, usually a downwardly opening notch in the back portion of the crown with an elastic tape bridging between the opposite edges of the notch to constrict the notch for sizing the headband.

An alternative type of sizing band has been proided for hardhats which have button and socket fasteners for connecting ends of the headband in different degrees of overlapping to size the hat.

SUMMARY OF THE INVENTION

A principal object of the invention is to provide a sizing band for headgear such as a cap or hat.

It is also an object to provide a cap which is readily convertible from a mild weather condition in which a neck flap and earflaps can be held securely in position turned up alongside the lower portion of the cap crown and an inclement weather condition in which the neck flap and earflaps are turned down and are snugged close to the wearer's neck and ears.

A more specific object is to provide fastening means conveniently operable to hold the earflaps securely in their upwardly folded positions and which fastening means can serve to hold a chin strap in place when the earflaps are in their downturned positions.

A further object is to provide snugging mechanism for drawing a neck flap and earflaps close to the neck and ears when they are in their positions depending from the cap crown.

Another object is to provide an arrangement for conveniently securing in place a liner lining the cap crown.

The foregoing objects can be accomplished by providing an annular pocket formed by a tubular headband around the lower portion of the crown in which a sizing tape is slidably received so that its effective length can be adjusted by altering the degree of overlap of the end portions of such tape which pass through slots from the hollow headband into the interior of the crown. Complemental portions of hook and pile or Velcro fasteners can be provided on the outer sides of the earflaps and on the crown in positions for interengagement to hold the earflaps in upwardly folded position and when the earflaps are turned downward such fastening means can be used to hold opposite ends of a chin strap to the earflaps. Further, a draw string can be provided for the lower portion of the neck flap and earflaps to gather such lower portion for snugging it against the neck.

BRIEF DESCRIPTION OF THE DRAWINGS

FIG. 4 is a side elevation of the cap showing the neck flap and earflaps in downturned position, and FIG. 5 is a fragmentary rear elevation of a portion of the neck flap and crown of the cap.

FIG. 10 is a fragmentary inside elevation of the lower rear portion of the cap.

DETAILED DESCRIPTION

A representative type of headgear in which the present invention can be incorporated is a cap of the sportsmen's type including a crown 1 of generally form-fitting shape and a conventional visor 2. A skirt depending from the sides and rear portion of the cap crown provides a neck flap 3 and opposite earflaps 4. As shown in FIG. 4, the width of the central portion of the neck flap at the rear of the cap is considerably less than the width of the earflaps.

Figure 2:
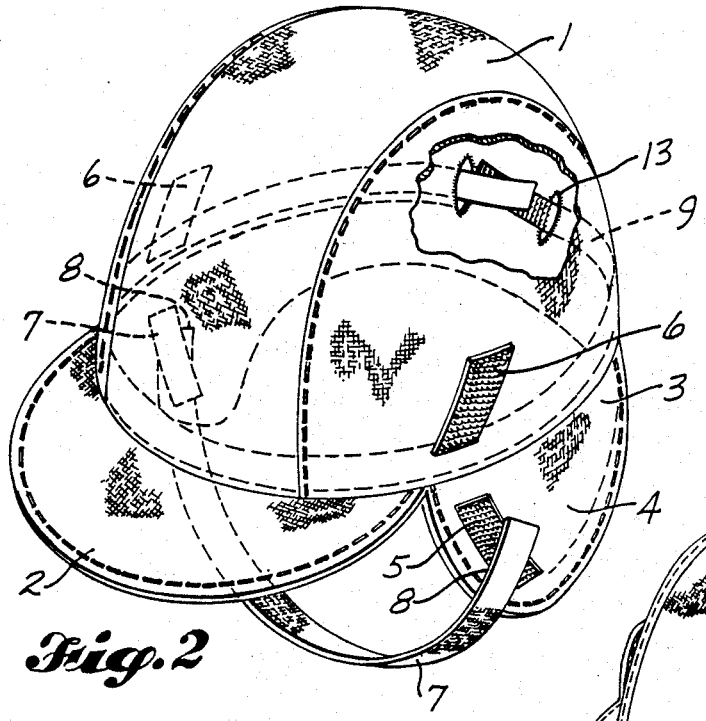
FIG. 2 is an enlarged top perspective of the cap showing the earflaps and neck flap in downturned position.
Figure 1:
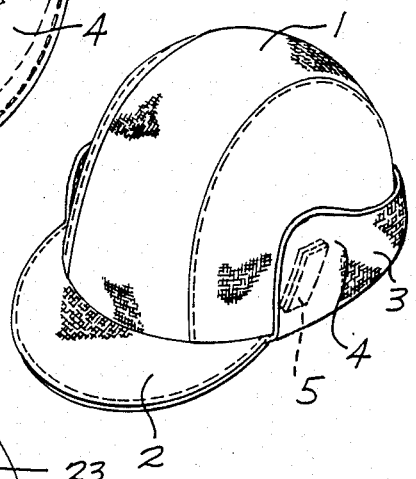
FIG. 1 is a top perspective of the cap of the present invention showing the neck flap and earflaps in upwardly folded position.
Figure 8:
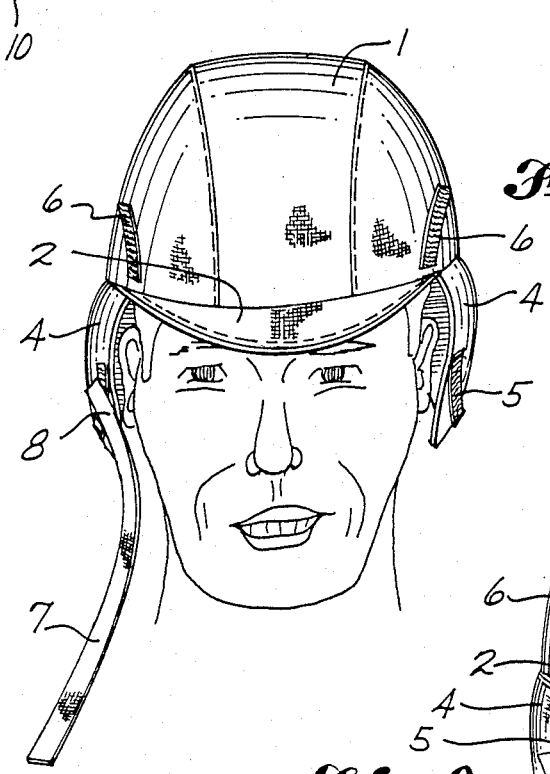
FIG. 8 and FIG. 9 are front elevations of the cap being worn showing the cap in different conditions.

During good weather, the neck flap 3 and earflaps 4 can be folded up alongside the lower portion of the crown 1 as shown in FIG. 1. To maintain the neck flap and earflap skirt securely in this upwardly folded position, a hook and pile type of fastener, such as Velcro, can be used. Such fastener includes a pile patch 5 secured to the outer surface of the earflaps 4 which can engage with a nylon hook patch 6 attached to the crown 1. The pile components 5 of the hook and pile fasteners can also be used when the earflaps 4 are in the downturned position shown in FIG. 2 to attach the ends of a chin strap 7 to the earflaps. Each end of the chin strap carries a hook component 8 of the hook and pile fastener which can be attached to the pile components 5, respectively, on the opposite earflaps, as shown in FIG. 2. FIG. 8 shows the chin strap having one end fastened to one earflap and the remainder of the chin strap dangling from that earflap when the earflaps are in their downturned positions without both ends of the chin strap being secured.

The headband of the headgear, such as a cap or a hat, can be sized easily for the particular individual by providing a sizing band 9 received within the hollow 10 formed by securing the upper and lower edges of a headband to the crown around the lower portion of the crown 1 substantially at the location of the largest circumference of the head. Opposite end portions 11 and 12 of the sizing band can pass through slots 13 in the headband circumferentially spaced in adjacent relationship preferably at the rear of the cap. Such slots allow the opposite end portions, respectively, of the sizing band 9 to be in the interior of the cap between such slots instead of being in the hollow 10 between the headband and the crown. Mutually facing sides of such sizing band end portions between the slots 13 carry hook and pile fastener components, respectively, so that such end portions can be held together readily in different overlapping positions to provide adjustability lengthwise of the sizing band to alter the effective length of the band so that the cap will fit snugly on heads of different size.

In order to enable the lower portion of the neck flap 3 and earflaps 4 to be pulled snugly against the wearer's neck, a drawstring 14 is provided through the hollow 15 formed by a hem extending along the lower edge of the neck flap and earflap skirt. Ends of the drawstring pass through the aperture of a gripper or clamping slide 16 which can grip the drawstring in different adjusted positions. The ends of the drawstring are tied together in a knot 17 to prevent the gripper from sliding off the ends of the drawstring segments. The gripper or slide is of conventional type including a casing having a transverse hole through it and receiving a plunger with a transverse aperture through which two stretches of the drawstring pass. A compression spring within the housing shifts the plunger axially relative to the housing tending to move the plunger aperture and the housing apertures out of registration to clamp the drawstring. The fastener can be released by pressing on the plunger head 18 to shift the plunger so that the plunger aperture and the casing aperture are moved into registration to release the grip on the drawstring so that the drawstring segments can be moved through the fastener.

Figure 6:
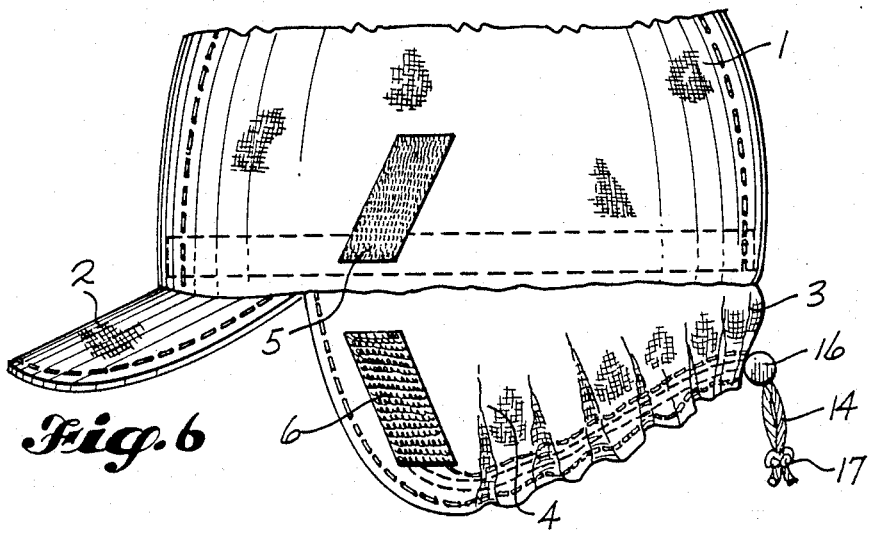
FIG. 6 is a side elevation of the cap corresponding to FIG. 4 but showing parts in a different condition.
Figure 7:
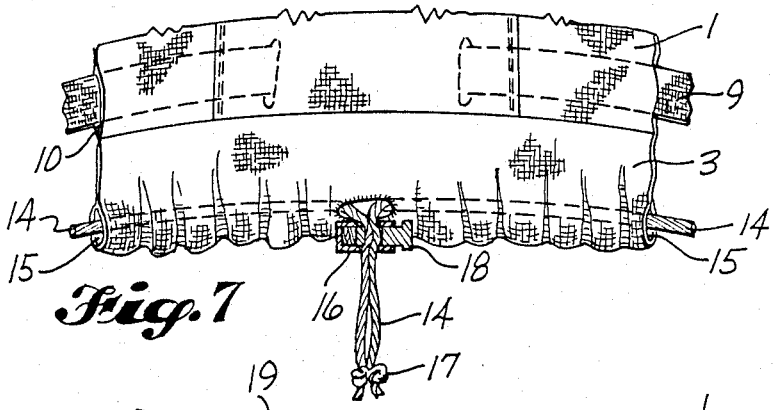
FIG. 7 is a fragmentary rear elevation of a portion of the cap corresponding to FIG. 5 but showing the parts in a different condition.
Figure 9:
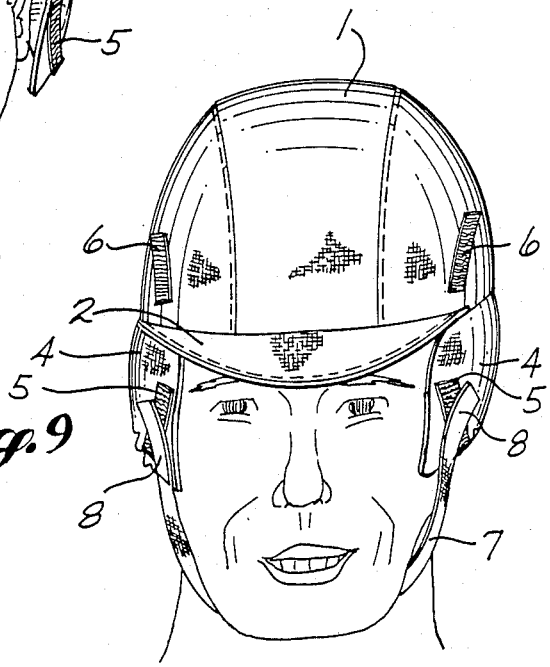

When the neck flap and earflap skirt is in relaxed condition, the skirt will be smooth as shown in FIGS. 5 and 10. When the fastener is released the drawstring can be pulled through the fastener 16 from the position of FIGS. 4, 5, 10 and 11 to the snugged position of FIGS. 6 and 7, so that the neck flap and earflaps are drawn close to the head from the position shown in FIGS. 4 and 8 to the position in which the lower margin of the neck flap is gathered as shown in FIGS. 6 and 9.

Figure 3:
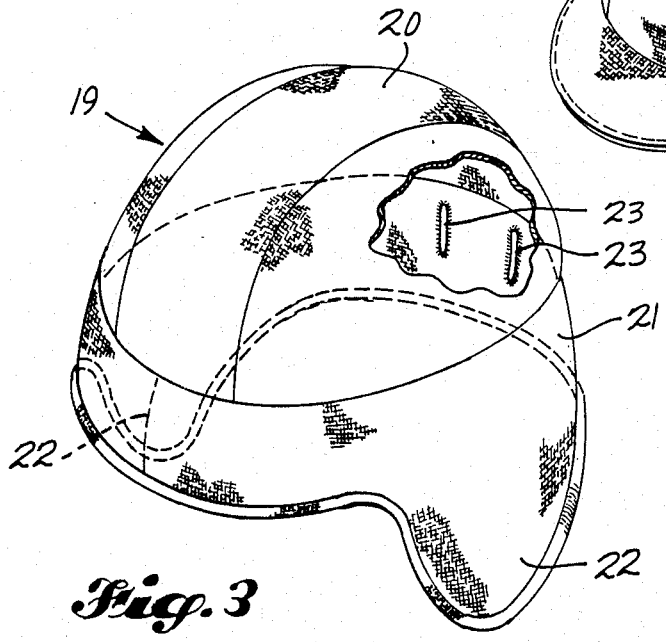
FIG. 3 is a top perspective of a liner for the cap.
Figure 11:
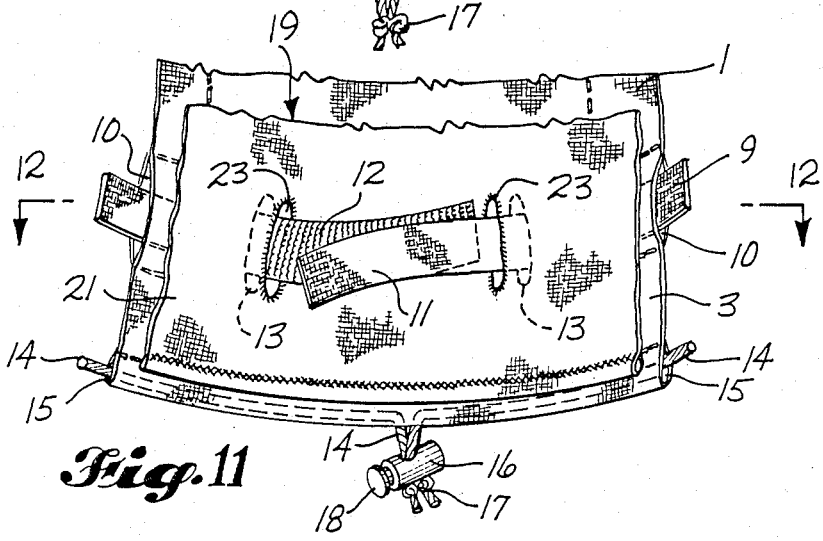
FIG. 11 is a similar fragmentary inside elevation of the lower rear portion of the cap and a corresponding portion of a liner fitted within the cap.
Figure 12:
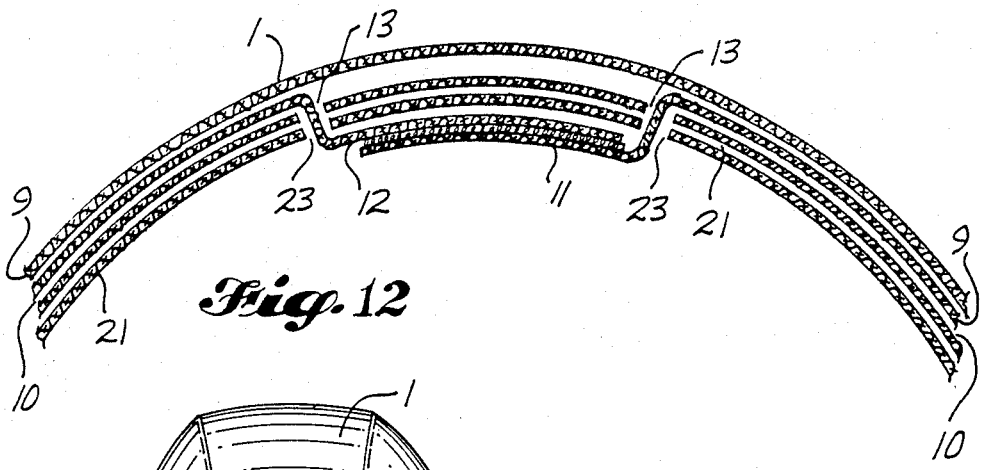
FIG. 12 is an enlarged, fragmentary, horizontal section through the lower rear portion of the cap end liner taken along 12—12 of FIG. 11.

For winter weather, it may be desirable to provide a liner 19 for increasing the warmth of the cap. This liner can be a quilted liner if desired. Such liner is shown in FIG. 3 as including a crown 20 from which depends a skirt having a neck flap section 21 and earflap sections 22. The rear portion of such neck flap section has parallel slots 23 spaced apart circumferentially for disposition in substantial registration with the cap neckband slots 13, as shown in FIGS. 11 and 12, so that the end portions 11 and 12 of the sizing band can pass from the tubular headband first through the cap slots 13 and then through the liner slots 23 for disposition of the end portions 11 and 12 of the sizing band inwardly of the liner skirt, as shown in FIGS. 11 and 12. When the hook and pile fastener components carried by the ends of the sizing band are secured in overlapping relationship, the sizing band serves the dual purpose of sizing the cap for the particular wearer and retaining the liner securely within the cap. The liner may be of sufficient thickness so that it is desirable to alter the overlap of the sizing band ends 11 and 12 different distances depending upon whether the liner is in the cap or not in order to enable the cap to fit properly on the head of a particular wearer in either instance.

I claim:

1. Headgear comprising a crown, a headband carried by the lower portion of said crown, a length-adjustable sizing band received between said headband and said crown, said headband having adjacent circumferentially spaced slots through which the end portions of said sizing band can pass to the interior of the headgear, connecting mean for connecting the ends of said sizing band and adjustable to alter the effective circumferential extent of said sizing band, and a liner lining the interior of said crown and having a depending portion extending downward over said headband slots through which the ends of said sizing band extend, and said depending portion of said liner having slots therein corresponding generally to the positions of said headband slots for enabling the ends of said sizing band to extend inward therethrough for connection by said connecting means to hold said liner in said crown.

2. Headgear comprising a crown, a headband for encircling substantailly the largest circumference of the head, a skirt depending below the sides and rear portion of said headband and forming a neck flap at the rear and earflaps at the opposite sides of the cap, said headband lining interiorly the lower portion of said crown and having its upper and lower edge portions secured to said crown to form an annular hollow extending circumferentially of the headgear between said headband and said crown, a flat length-adjustable sizing band received in such annular hollow, said headband having adjacent circumferentially spaced slots through which the flat end portions of said sizing band, respectively, pass from such annular hollow to the interior of the headgear, and flat connecting means inside the headgear between said headband slots and exposed to the interior of the headgear for connecting the flat end portions of said sizing band with an adjustable overlap to alter the effective circumferential extent of said sizing band.

3. A cap comprising a crown having earflaps depending from opposite sides thereof, crown fastening means on the opposite sides of said crown, a chin strap, chin strap fastening means on the opposite ends of said chin strap which are not complemental to said crown fastening means, and earflap fastening means on the outer sides of said earflaps complemental to both of said crown fastening means and said chin strap fastening means and located for selective attachment of said earflap fastening means with said crown fastening means to hold said earflaps in upwardly folded position and with said chin strap fastening means to secure the ends of said chin strap to said earflaps, respectively.

4. The cap defined in claim 3, in which each of the fastening means constitutes one component of hook and pile type of fastening means.

* * * * *